US010064523B2

(12) United States Patent
Engell et al.

(10) Patent No.: US 10,064,523 B2
(45) Date of Patent: Sep. 4, 2018

(54) TILT RESISTING SHOWER CADDIES

(71) Applicant: Maytex Mills, Inc., New York, NY (US)

(72) Inventors: David H. Engell, Stamford, CT (US); Benjamin Scanlon, Philadelphia, PA (US)

(73) Assignee: Maytex Mills, Inc., New York, NY (US)

( * ) Notice: Subject to any disclaimer, the term of this patent is extended or adjusted under 35 U.S.C. 154(b) by 0 days.

(21) Appl. No.: 15/714,573

(22) Filed: Sep. 25, 2017

(65) Prior Publication Data

US 2018/0008102 A1 Jan. 11, 2018

Related U.S. Application Data

(63) Continuation-in-part of application No. 15/417,478, filed on Jan. 27, 2017, now Pat. No. 9,770,138.

(60) Provisional application No. 62/288,711, filed on Jan. 29, 2016, provisional application No. 62/371,985, filed on Aug. 8, 2016.

(51) Int. Cl.

| | |
|---|---|
| ***A47G 29/087*** | (2006.01) |
| ***A47K 3/28*** | (2006.01) |
| ***A47K 5/03*** | (2006.01) |
| *D06F 57/12* | (2006.01) |

(52) U.S. Cl.

CPC ..... *A47K 3/281* (2013.01); *A47K 5/03* (2013.01); *D06F 57/12* (2013.01)

(58) Field of Classification Search

CPC ..... A47B 55/02; A47B 57/26; A47K 3/281; A47K 5/03; A47K 5/04; D06F 57/12

USPC .... 211/119.009, 119.011, 119.004, 119, 117, 211/85.31, 106, 113, 103, 187, 190, 207, 211/107, 181.1; D6/525, 566

See application file for complete search history.

(56) References Cited

U.S. PATENT DOCUMENTS

| | | | | | |
|---|---|---|---|---|---|
| 364,803 | A * | 6/1887 | Christian | A47G 25/442 | 223/89 |
| 626,739 | A * | 6/1899 | Vanderman | A47K 1/09 | 211/119.009 |
| 768,446 | A * | 8/1904 | Gager | A47G 25/4023 | 223/94 |
| 1,184,700 | A * | 5/1916 | McCallum | A47G 25/28 | 223/88 |
| 1,248,577 | A * | 12/1917 | Vincent | A47G 25/4023 | 223/89 |
| 1,554,137 | A * | 9/1925 | Slifkin | A47B 57/52 | 108/6 |
| 1,638,844 | A * | 8/1927 | Gibson | A47G 25/442 | 223/89 |
| 1,868,726 | A | 7/1932 | Collier | | |
| 1,987,723 | A * | 1/1935 | Thomasma | A47K 17/003 | 211/119.009 |
| 2,214,118 | A * | 9/1940 | Bracken | A45C 13/03 | 211/113 |

(Continued)

*Primary Examiner* — Abigail E Troy
*Assistant Examiner* — Devin K Barnett
(74) *Attorney, Agent, or Firm* — Christopher J. Owens, Esq.; Leech Tishman Fuscaldo & Lampl

(57) ABSTRACT

Shower caddies with a tilt-resisting locking mechanism that resists rotation of the caddies when supporting an uneven load. The shower caddies may also include vertically and horizontally movable baskets that are independently adjustable by a mechanism, which allows the user to adjust both the vertical and horizontal position of the basket.

14 Claims, 12 Drawing Sheets

(56) References Cited

U.S. PATENT DOCUMENTS 2,222,091 A * 11/1940 Schray ..... A47F 5/13 108/28
2,335,285 A * 11/1943 Kinney ..... A47G 25/442 223/89
2,354,099 A * 7/1944 Bess ..... A47G 25/60 223/86
2,428,820 A * 10/1947 Therrien ..... A47G 25/32 223/88
2,513,980 A * 7/1950 Widmann ..... A47G 25/443 223/89
2,519,987 A 8/1950 Wernette
2,535,625 A * 12/1950 Corwin ..... A47G 25/54 211/118
2,641,366 A * 6/1953 Burch ..... A47G 25/005 211/118
2,682,978 A * 7/1954 Brock ..... A47G 25/442 223/89
2,701,082 A * 2/1955 Cohen ..... A47G 25/325 223/85
2,760,648 A * 8/1956 Dusen ..... A47G 25/743 211/106
D190,608 S * 6/1961 Forrester ..... 211/119
3,111,723 A * 11/1963 Bates ..... E04L 32/821 160/135
3,131,817 A * 5/1964 Schenkler ..... A47G 25/32 223/85
3,141,221 A 7/1964 Faulls, Jr.
3,181,702 A * 5/1965 Raphaei ..... A47K 3/281 211/119
3,642,241 A * 2/1972 Kaufman ..... A61M 5/1415 211/117
3,789,996 A * 2/1974 Stroh ..... A47K 1/09 211/106
3,860,154 A * 1/1975 Atkins ..... A47G 25/32 211/113
3,923,162 A * 12/1975 Hussey ..... A47F 5/14 211/119
4,467,925 A * 8/1984 Ratzloff ..... B25H 3/04 211/103
5,083,729 A * 1/1992 Saeks ..... B62H 3/12 211/17
5,085,357 A * 2/1992 Chen ..... A47G 25/4038 223/85
5,160,105 A 11/1992 Miller
5,255,401 A * 10/1993 Sambrookes ..... A47K 3/281 206/77.1
5,613,628 A * 3/1997 Burkhalter ..... A47G 25/16 223/83
6,089,387 A * 7/2000 Varfolomeeva ..... A47B 57/06 211/106
6,244,479 B1 * 6/2001 Sugita ..... A47G 25/403 223/94
6,412,647 B1 * 7/2002 Ko ..... A47B 55/02 211/106
6,494,327 B2 * 12/2002 Huang ..... A47F 5/0892 211/107
6,520,351 B1 * 2/2003 Zadro ..... A47K 3/281 211/106
D473,411 S * 4/2003 Walker ..... D6/525
6,581,790 B1 * 6/2003 Zadro ..... A47K 3/281 211/119
D479,073 S * 9/2003 Snell ..... A47K 3/281 D6/525
D479,074 S * 9/2003 Snell ..... A47K 3/281 D6/525
6,726,161 B2 * 4/2004 Plump ..... B05B 15/065 248/205.1
D493,991 S * 8/2004 Dretzka ..... A47K 3/281 D6/525
D494,794 S * 8/2004 Winkleman ..... A47K 3/281 D6/525
D496,549 S * 9/2004 Snell ..... A47K 3/281 D6/525
D498,102 S * 11/2004 Snell ..... A47K 3/281 D6/525
6,971,381 B2 12/2005 Langford
D530,551 S * 10/2006 Snell ..... D6/525
D552,391 S * 10/2007 Rosen ..... A47K 3/281 D6/525
D557,050 S * 12/2007 Dretzka ..... A47K 3/281 D6/525
D562,608 S * 2/2008 Kramer ..... D6/525
D564,271 S * 3/2008 Snider ..... A47K 3/281 D6/525
D566,439 S * 4/2008 Dretzka ..... A47K 3/281 D6/525
D568,657 S * 5/2008 Snider ..... A47K 3/281 D6/525
D568,658 S * 5/2008 Yang ..... A47K 3/281 D6/525
D569,149 S * 5/2008 Walker ..... A47K 3/281 D6/525
D572,061 S * 7/2008 Snider ..... A47K 3/281 D6/525
D572,062 S * 7/2008 Snider ..... A47K 3/281 D6/525
D572,502 S * 7/2008 Yang ..... D6/525
D573,822 S * 7/2008 Yang ..... D6/523
D575,087 S * 8/2008 Ghiorghie ..... A47K 3/281 D6/525
7,527,157 B2 * 5/2009 Shinn ..... B25H 3/006 211/119
7,611,034 B1 * 11/2009 Peterson ..... A47G 25/743 211/115
D615,333 S * 5/2010 Snell ..... A47K 3/281 D6/525
7,731,068 B2 * 6/2010 Scicluna ..... A47G 25/32 223/88
7,770,742 B1 * 8/2010 Wagner ..... A47K 3/281 211/113
D622,990 S * 9/2010 Yang ..... D6/525
7,798,339 B2 * 9/2010 Brooks ..... G11B 33/02 211/103
D628,000 S * 11/2010 Lindo ..... A47K 3/281 D6/525
D628,841 S * 12/2010 Yang ..... D6/525
D632,513 S * 2/2011 Cittadino ..... A47K 3/281 D6/525
D640,488 S * 6/2011 Didehvar ..... D6/525
D641,191 S * 7/2011 Walker ..... D6/525
D643,657 S * 8/2011 Cittadino ..... D6/525
D644,050 S * 8/2011 Cittadino ..... D6/525
D651,837 S * 1/2012 Yang ..... D6/525
8,100,305 B2 * 1/2012 Sun ..... B60R 7/10 223/85
8,186,521 B2 * 5/2012 Yu ..... A47B 55/02 211/106
8,225,946 B2 7/2012 Yang et al.
8,256,649 B2 * 9/2012 Camp ..... A47G 25/32 223/85
D676,696 S * 2/2013 Primeau ..... D6/525
D677,956 S * 3/2013 Tawil ..... D6/525
8,820,543 B2 * 9/2014 Huang ..... B62H 3/12 211/107
D714,571 S * 10/2014 Walker ..... D6/525
D718,071 S * 11/2014 Snider ..... D6/525
D718,554 S * 12/2014 Snider ..... D6/525
D723,834 S * 3/2015 Tawil ..... D6/525
D728,260 S * 5/2015 Snider ..... D6/525
9,357,860 B1 * 6/2016 Klowan ..... A47K 3/281
D769,017 S * 10/2016 Tsai ..... D6/525
D769,641 S * 10/2016 Yang ..... D6/525
D770,197 S * 11/2016 Yang ..... D6/525
9,693,660 B1 * 7/2017 Stelmarski ..... A47K 3/281
2003/0000905 A1 * 1/2003 Zidek ..... A47F 5/01 211/205
2004/0188369 A1 * 9/2004 Yu ..... A47K 5/04 211/106

(56) References Cited

U.S. PATENT DOCUMENTS

2004/0200936 A1* 10/2004 Opperthauser ..... F16L 59/135 248/62
2006/0261022 A1* 11/2006 Sampaio ..... A47K 3/281 211/119.009
2008/0047913 A1* 2/2008 Naden ..... A47K 3/281 211/119.009
2008/0053935 A1* 3/2008 Newbouild ..... A47B 57/08 211/90.02
2008/0164384 A1* 7/2008 Rosen ..... D06F 79/02 248/117.1
2008/0224011 A1* 9/2008 Chang ..... A47K 3/281 248/317
2008/0230494 A1* 9/2008 Galt ..... A47K 13/06 211/13.1
2008/0283558 A1* 11/2008 Rude ..... A47G 25/32 223/94
2009/0145801 A1* 6/2009 Moon ..... A47K 3/281 206/581
2009/0188880 A1* 7/2009 Yang ..... A47K 3/281 211/113
2010/0102014 A1* 4/2010 Yang ..... A47K 3/281 211/113
2010/0133218 A1* 6/2010 Yang ..... A47K 3/281 211/119.009
2012/0091088 A1* 4/2012 Didehvar ..... A47B 45/00 211/113
2012/0159748 A1* 6/2012 Carney ..... A47K 3/281 24/457
2012/0217215 A1* 8/2012 Emery ..... A47K 3/281 211/119.009
2014/0124467 A1* 5/2014 Kwok ..... A47K 3/281 211/113
2014/0224754 A1* 8/2014 Baines ..... A47K 3/281 211/119.009
2014/0284293 A1* 9/2014 Greco ..... A47K 3/281 211/85.12
2014/0319083 A1* 10/2014 Stark ..... A47K 3/281 211/26
2015/0157124 A1* 6/2015 Cipolla ..... A47F 5/02 211/86.01
2015/0342419 A1* 12/2015 Yatscoff ..... A47K 3/281 211/119.011
2016/0066751 A1* 3/2016 Hinson ..... A47K 3/281 211/85.12
2016/0091118 A1* 3/2016 Alexander ..... E03C 1/06 248/56
2016/0374467 A1* 12/2016 Gasparino ..... A47B 45/00 211/119.011
2017/0360261 A1 12/2017 Coratolo et al.

* cited by examiner

TILT RESISTING SHOWER CADDIES

CROSS-REFERENCE TO RELATED APPLICATIONS

This application is a continuation-in-part of U.S. patent application Ser. No. 15/417,478, filed Jan. 27, 2017, which claims the benefit of U.S. Provisional Patent Application Ser. No. 62/288,711 filed Jan. 29, 2016 and U.S. Provisional Patent Application Ser. No. 62/371,985 filed Aug. 8, 2016, all of which are incorporated herein by reference.

FIELD OF THE INVENTION

The present invention relates to shower caddies, and more particularly relates to shower caddies that are tilt resistant.

BACKGROUND INFORMATION

Conventional shower caddies include baskets arranged vertically on a support member extending downward from an upper hook that engages a shower pipe. The baskets are typically rigidly mounted on the support member. This arrangement often precludes the storage of larger containers of shower and bath products.

An additional disadvantage of conventional shower caddies is that they tilt due to the weight of items that are placed on or removed from the caddies. Some shower caddies use rubber grips or suction cups at their bottoms to help control the tilting, but if the objects placed in the baskets are sufficiently heavy they may still tilt.

SUMMARY OF THE INVENTION

The present invention provides shower caddies with a tilt-resisting locking mechanism that resists rotation of the caddies when supporting an uneven load. The shower caddies may also include vertically and horizontally movable baskets that are independently adjustable by a mechanism, which allows the user to adjust both the vertical and horizontal position of the basket.

An aspect of the present invention is to provide a tilt-resisting shower caddy assembly comprising a tilt-resisting support hook comprising a generally U-shaped upper portion and first and second downwardly extending side legs, a vertical support structure connected to at least one of the downwardly extending side legs supporting at least one basket, a snap clip engaging the generally U-shaped upper portion comprising upper curved portion and first and second legs having bulbous gripping ends, the snap clip having an interior surface defining a generally cylindrical shower pipe receiving channel having a radius R and defining a centerline height $C_C$ and at least one threaded fastener extending from an exterior side surface to an interior side surface of at least one of the first and second downwardly extending side legs at a height H measured downward from the centerline height $C_C$ of from 0 to 60 percent of the radius R of the pipe cylindrical channel structured and arranged to extend inward from the exterior side surface to thereby resist tilting of the shower caddy assembly when installed on the shower pipe.

This and other aspects of the present invention will be more apparent from the following description.

DETAILED DESCRIPTION

Figure 1:
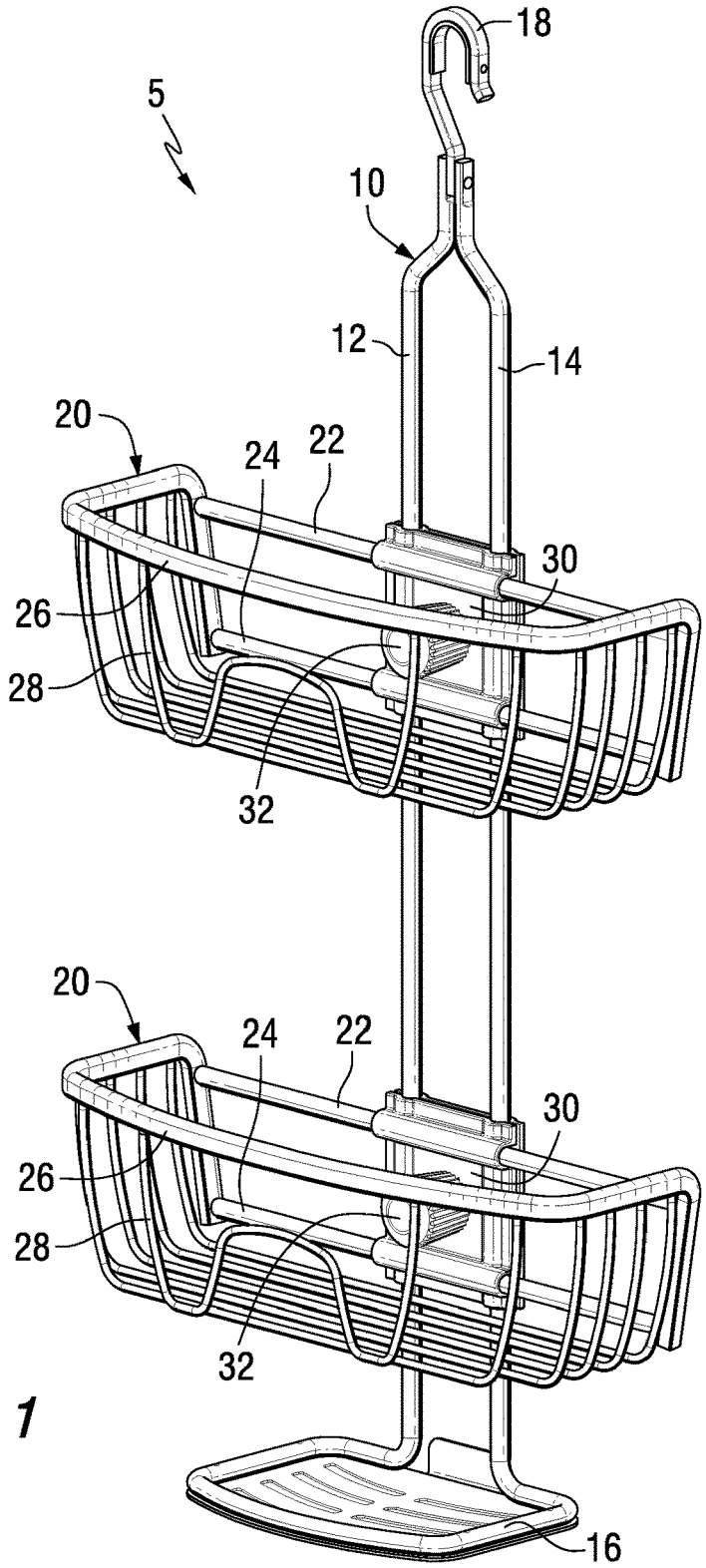
FIG. 1 is an isometric view of a shower caddy assembly including adjustment mechanisms in accordance with an embodiment of the present invention.
Figure 4:
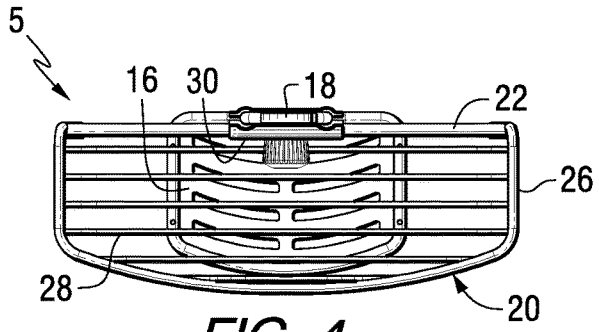
FIG. 4 is a top view of the shower caddy of FIG. 1.
Figure 2:
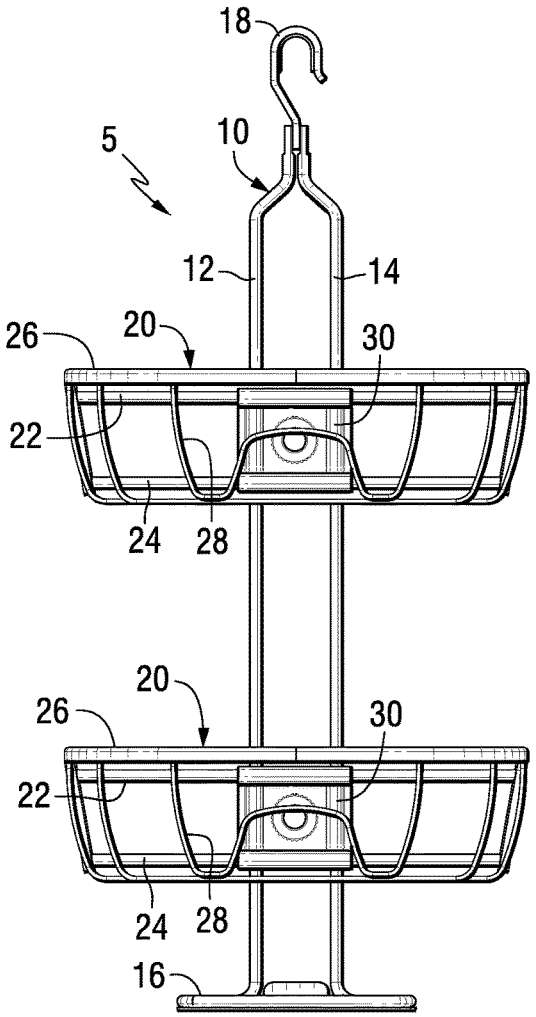
FIG. 2 is a front view of the shower caddy of FIG. 1.

FIG. 1 illustrates a shower caddy assembly 5 in accordance with an embodiment of the present invention. The shower caddy assembly 5 includes a vertical support structure 10 comprising a first vertical support rod 12, a second vertical support rod 14 parallel with the first vertical support rod 12, and a bottom shelf 16. The vertical support structure 10 may be mounted on a shower pipe connected to a shower head (not shown) by a tilt-resisting support hook 18, which is described in more detail below. In the embodiment shown, the shower caddy assembly 5 includes two baskets 20 mounted on the vertical support structure 10 by an adjustment mechanism 30. The baskets 20 are configured to hold a variety of bathing accessories. While two baskets 20 of similar size are shown in this embodiment, any other suitable number of baskets 20 may be used. For example, one, three, four or more baskets may be mounted on the vertical support structure 10. In addition, the baskets may vary in size, for example, the top basket may be smaller than the bottom basket.

As shown in FIGS. 1-4, each basket 20 includes an upper horizontal basket support rod 22, a lower horizontal basket support rod 24, a retaining rod 26 and retaining wire 28. In the embodiment shown, each basket 20 comprises two horizontal basket support rods, however, it is to be understood that any other suitable number of horizontal basket support rods may be used, e.g., one, two, three or more horizontal basket support rods. For example, a basket 20 with a single horizontal support rod at the upper edge of the basket 20 may be used. The upper and lower horizontal basket support rods 22 and 24 are located at the rear of each basket 20, are parallel with each other, and are vertically offset from each other. In the embodiment shown, the retaining rod 26 is connected to the upper and lower horizontal basket support rods 22 and 24 and forms the upper front and side portions of the basket 20. The retaining wire 28 is connected to the retaining rod 26 and forms the bottom of the basket 20. In accordance with another embodiment, the upper and/or lower horizontal basket support rods 22 and 24 may be extended along the side and front portions of the basket 20 thereby providing an integral structure in place of the retaining rod 26. In the embodiment shown, the retaining wire 28 is connected to the upper and lower horizontal basket support rods 22 and 24 to form the bottom of the basket 20 and to provide a rigid basket. While particular basket arrangements are described herein, it is to be understood that any other suitable basket structures may be used in accordance with the present invention.

In the embodiment shown, the bottom shelf 16 is formed by an extension of the first and second vertical support rods 12 and 14 which form the perimeter of the bottom shelf 16. In another embodiment, the bottom shelf 16 may be mounted on the vertical support structure 10 by an adjustment mechanism similar to the mechanism 30 used with the baskets 20. The bottom shelf 16 may be configured as a soap dish having a bottom formed by an insert placed into a central opening formed by the first and second vertical support rods. However, any other suitable arrangement of the bottom shelf 16 may be used. For example, the bottom shelf 16 may comprise a wire bottom, hooks or the like, or the bottom shelf may be eliminated.

Figure 5:
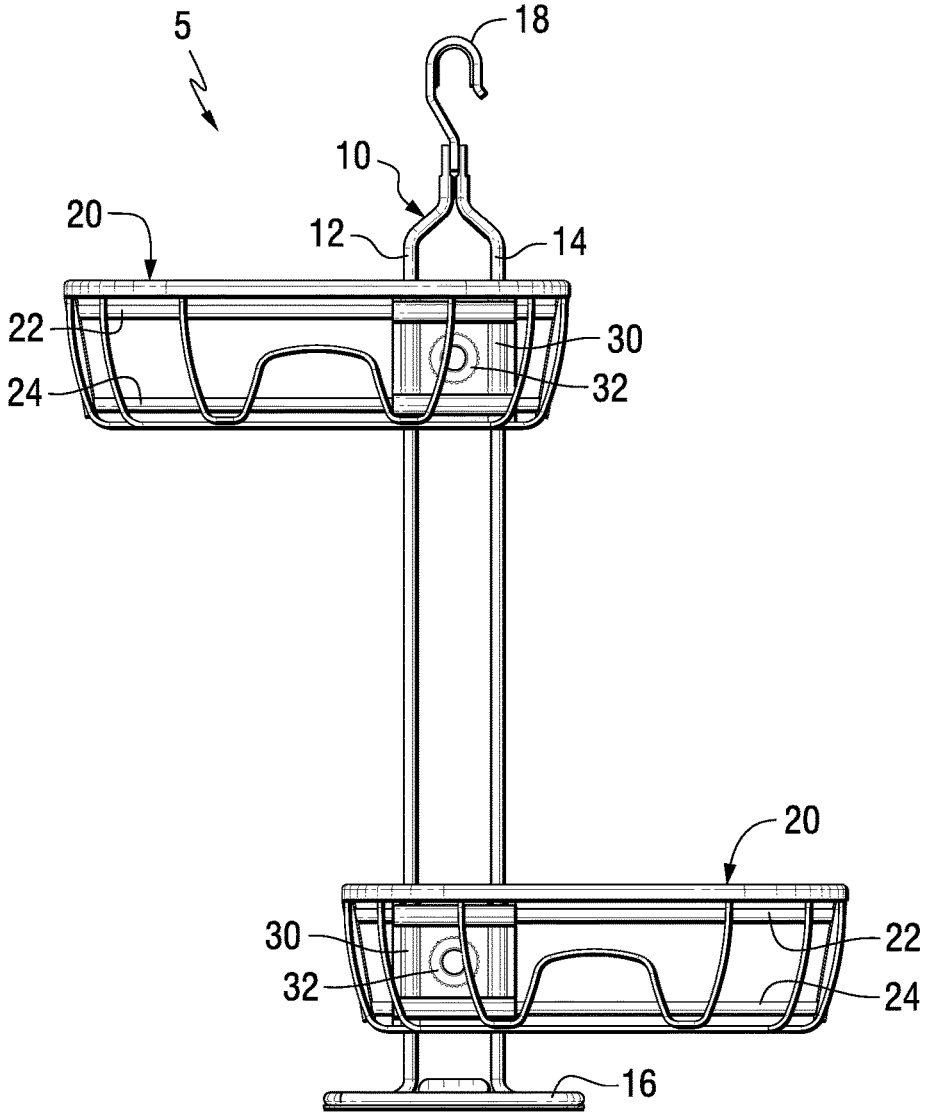
FIG. 5 is a front view of the shower caddy of FIG. 1, showing the baskets adjusted to different horizontal and vertical positions using the adjustment mechanisms in accordance with an embodiment of the present invention.

In accordance with embodiments of the present invention, the adjustment mechanism 30 includes a draw fastener 32 for selectively positioning the basket(s) 20 at desired locations. As shown by comparing FIGS. 2 and 5, each adjustment mechanism 30 of the shower caddy assembly 5 allows its respective basket 20 to be adjustably positioned at different horizontal positions, and at different vertical positions, in relation to the vertical support structure 10. When the shower caddy assembly 5 is mounted on a shower pipe (not shown), the first and second vertical support rods 12 and 14 of the vertical support structure remain stationary, while the adjustment mechanism 30 allows the baskets 20 to move both vertically up and down, and horizontally left and right. The ability of the baskets 20 to move both vertically and horizontally allows the shower caddy assembly 5 to easily accommodate containers and other bath items and accessories of varying sizes. As more fully described below, the provision of an adjustment mechanism 30 with a single draw fastener 32 allows for easy manipulation both horizontally and vertically of each basket 20 with a simple loosening and tightening of the draw fastener 32. The simple manipulation of the draw fastener 32 for each basket 20 can be performed at a single central location.

Figure 6:
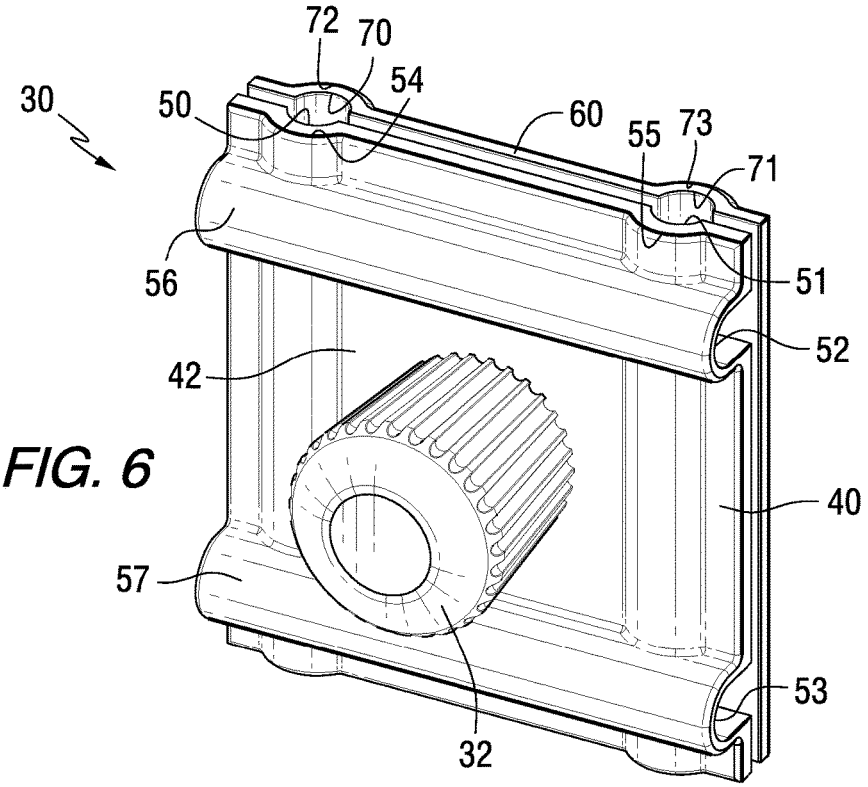
FIG. 6 is an isometric view of an adjustment mechanism in accordance with an embodiment of the present invention.
Figure 7:
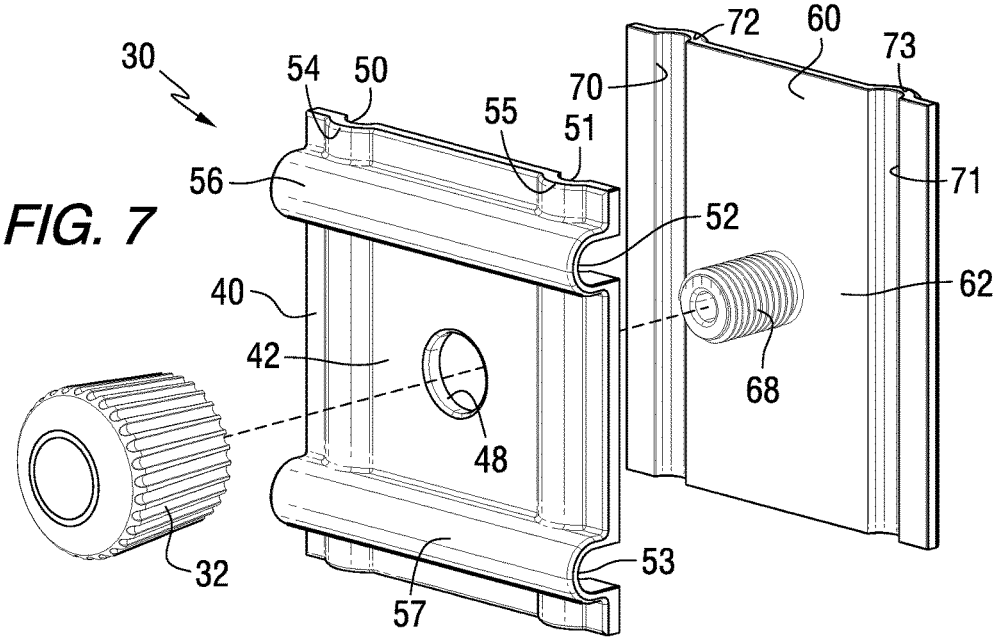
FIG. 7 is an exploded isometric view of the adjustment mechanism of FIG. 6.
Figure 8:
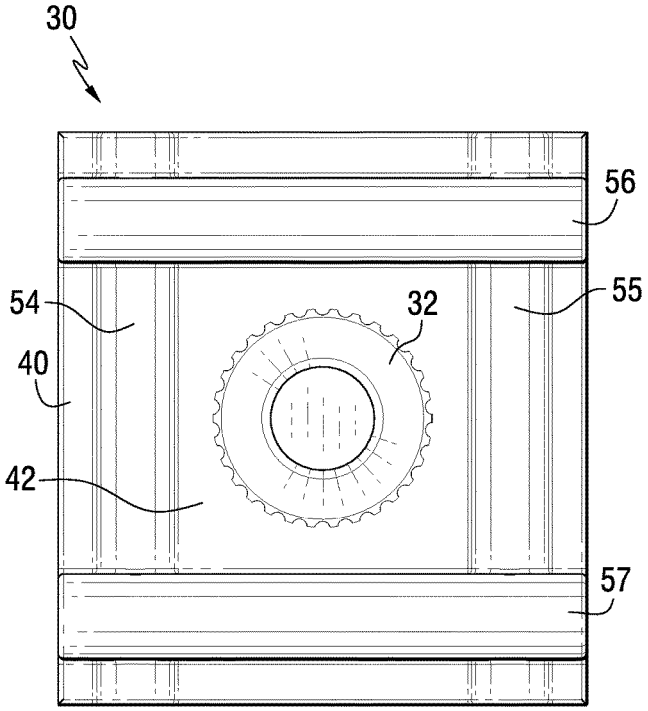
FIG. 8 is a front view of the adjustment mechanism of FIG. 6.

As shown in FIGS. 6-8, the adjustment mechanism 30 comprises a generally planar front plate 40, a generally planar back plate 60, and the draw fastener 32. When the shower caddy assembly 5 is installed, the front and back plates 40 and 60 are aligned in parallel vertical planes that are offset from each other. The front plate 40 is horizontally moveable from the back plate 60 in a direction normal to planes of the plates 40 and 60. The draw fastener 32 may be tightened to draw the front plate 40 toward the back plate 60 to secure the front and back plates against vertical movements with respect to the vertical support rods 12 and 14. The draw fastener 32 also secures each basket 20 against horizontal movement. In the embodiment shown, the draw fastener 32 comprises an internally threaded adjustment knob that may be threadingly engaged with a threaded stud 68 extending from the back plate, however, any other suitable hand manipulatable mechanism may be used. The draw fastener 32 may be rotated to increase the spacing between the plates 40 and 60 in order to allow sliding movement of the vertical support rods 12 and 14 within the adjustment mechanism 30, and to allow sliding movement of the horizontal basket support rods 22 and 24 within the adjustment mechanism 30. The draw fastener 32 of the adjustment mechanism 30 may thus provide a central control point for simple and easy operation.

The adjustment mechanisms 30 may be made of any suitable materials, including plastic, metals, or the like. For example, the front plate 30, back plate 60 and draw fastener 32 may be made of plastics such as polyethylene, polypropylene or polyvinyl chloride that are sufficiently rigid but slightly flexible to allow a desired amount of deflection when the draw fastener 32 is tightened to draw the front and back plates 40 and 60 together.

As shown in FIGS. 6-8 and 11, the front plate 40 includes a planar central region 42, left edge 43, right edge 44, top edge 45, bottom edge 46, and center opening 48. In the embodiment shown, the center opening 48 is located in the center of the planar central region 42 of the front plate. In the embodiment shown, a generally square front plate 40 having four straight edges is shown. However, any other suitable shape of front plate may be used, e.g., rectangular, circular, ovular, triangular, a shape having two straight edges and two curved edges, or the like.

Figure 10:
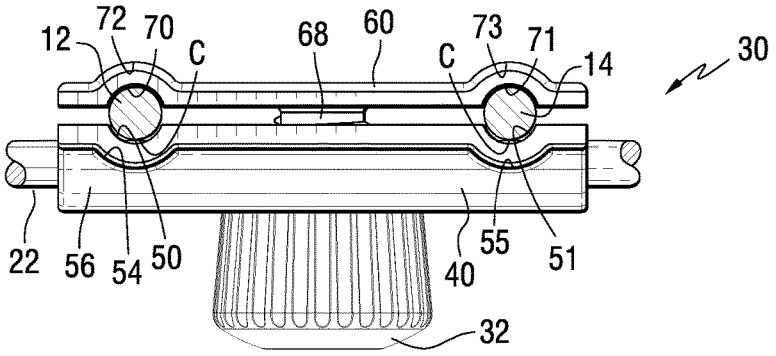
FIG. 10 is a top view of the adjustment mechanism of FIG. 6.
Figure 9:
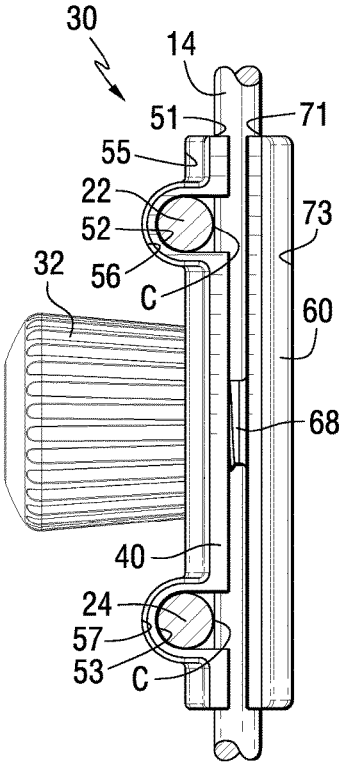
FIG. 9 is a side view of the adjustment mechanism of FIG. 6.
Figure 13:
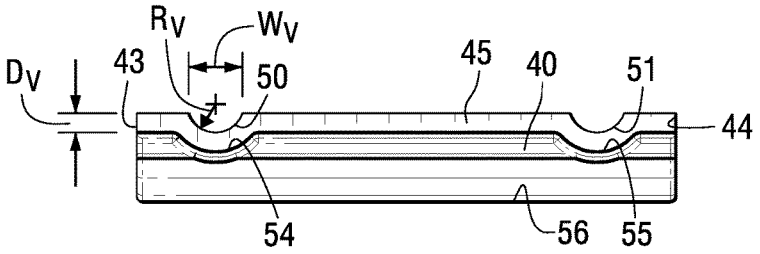
FIG. 13 is a top view of the front plate of FIG. 11.
Figure 11:
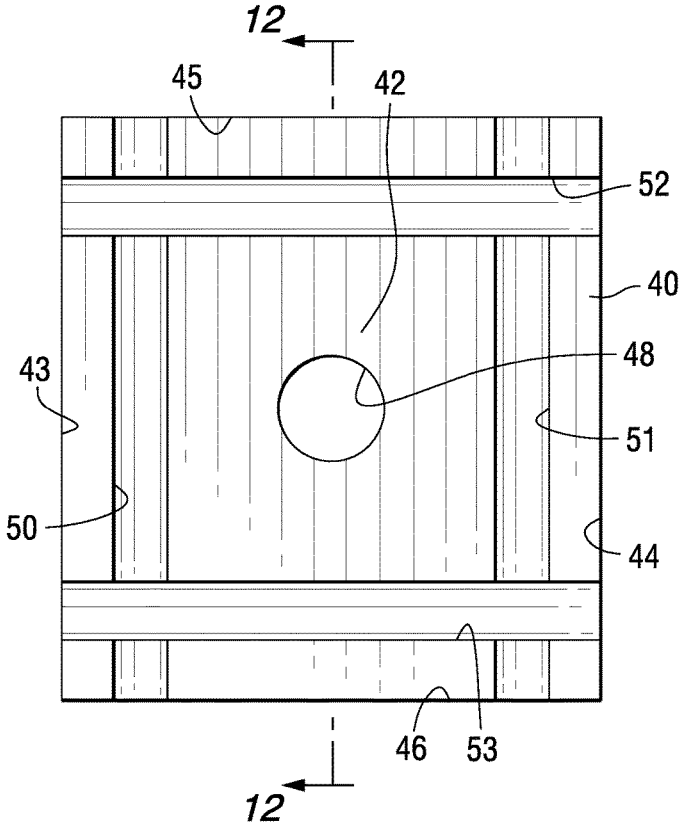
FIG. 11 is a front view of the front plate of the adjustment mechanism in accordance with an embodiment of the present invention.

In accordance with an embodiment of the present invention, the front plate 40 includes first and second vertical support rod receiving guide channels 50 and 51 recessed in a direction perpendicular to the planar surface of the front plate 40, as shown most clearly in FIGS. 11 and 13. Each of the vertical guide channels 50 and 51 has a vertical support rod slidably disposed therein, as shown in FIGS. 9 and 10. The front plate 40 also includes first and second horizontal rod receiving guide channels 52 and 53 recessed in a direction perpendicular to the planar surface of the front plate 40, as shown most clearly in FIGS. 11 and 12. Each of the horizontal guide channels 52 and 53 has a horizontal basket rod slidably disposed therein, as shown in FIGS. 9 and 10. For example, the first horizontal guide channel 52 may slidably receive the upper horizontal basket support rod 22 and the second horizontal guide channel 53 may slidably receive the lower horizontal basket support rod 24. In the embodiment shown, the front plate 40 comprises two horizontal guide channels, but any other suitable number of horizontal guide channels may be used, e.g., zero, one, three or more.

As shown in FIGS. 6-10, 12 and 13, the vertical guide channels 50 and 51 of the front plate 40 form vertical raised regions 54 and 55 on the front surface of the front plate 40. The horizontal guide channels 52 and 53 of the front panel 40 form horizontal raised regions 56 and 57 on the front surface. The vertical raised regions 54 and 55 and horizontal raised regions 56 and 57 thus extend forward from the planar front plate 40. In accordance with an embodiment of the present invention, the planar central region 42 is located in an interior region between the vertical raised regions 54 and 55 and horizontal raised regions 56 and 57.

As shown in FIGS. 3, 7 and 14-17, the back plate 60 includes a planar central region 62, left edge 63, right edge 64, top edge 65, bottom edge 66, and threaded stud 68. The threaded stud 68 may extend from the center of the planar central region 62 of the back plate, and is substantially aligned with the center opening 48 of the front plate 40. In accordance with an embodiment of the present invention, the internally threaded adjustment knob 32 is threadingly engaged with the threaded stud 68. In the embodiment shown, a generally square back plate 60 having four straight edges is shown. However, any other suitable shape of back plate may be used, e.g., rectangular, circular, ovular, triangular, a shape having two straight edges and two curved edges, or the like.

Figure 16:
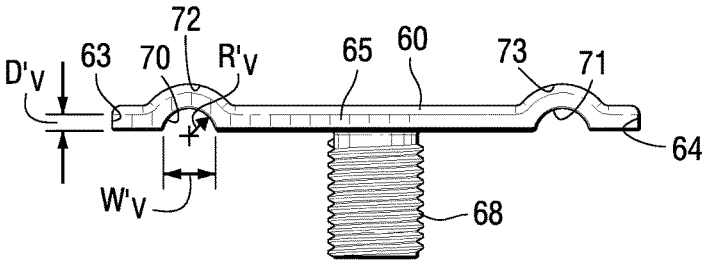
FIG. 16 is a top view of the back plate of FIG. 14.
Figure 14:
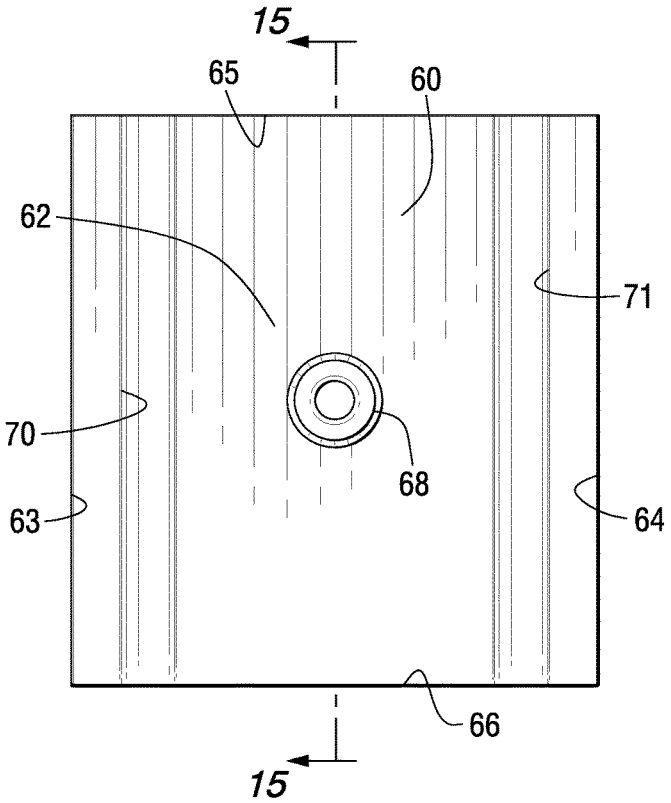
FIG. 14 is a front view of the back plate of the adjustment mechanism in accordance with an embodiment of the present invention.
Figure 15:
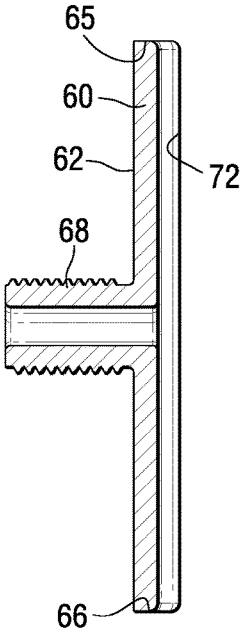
FIG. 15 is a sectional view of the back plate taken through line 16-16 of FIG. 15.
Figure 17:
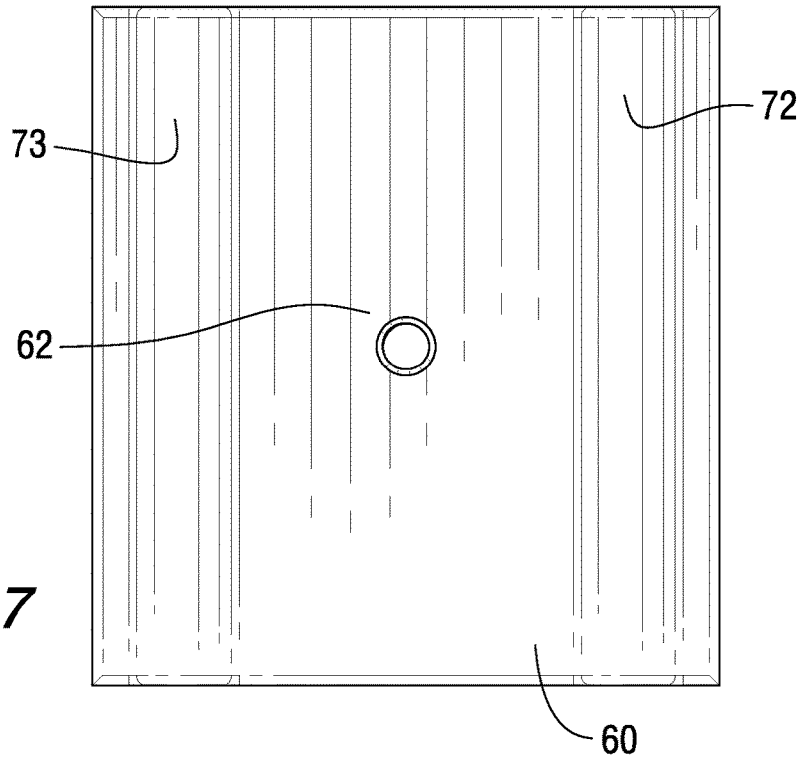
FIG. 17 is a back view of the back plate of FIG. 14.

In accordance with an embodiment of the present invention, the back plate 60 includes first and second vertical support rod receiving guide channels 70 and 71 recessed in a direction perpendicular to the planar surface of the back plate 60, as shown most clearly in FIGS. 14 and 16. Each of the vertical guide channels 70 and 71 has a vertical support rod slidably disposed therein, as shown in FIGS. 9 and 10.

As shown in FIGS. 6-10 and 15-17, the vertical guide channels 70 and 71 form vertical raised regions 72 and 73 on the back surface of the back plate 60. The vertical raised regions 72 and 73 thus extend backward from the planar back plate 60. In accordance with an embodiment of the present invention, the planar central region 62 is located in an interior region between the vertical raised regions 72 and 73.

The vertical support structure 10 and baskets 20 may be made of any suitable materials, including corrosion resistant metals such as aluminum and/or stainless steel, plastic or the like. Any suitable gauge of wire may be used for the rods of the vertical support structure 10 and baskets 20. In accordance with an embodiment of the present invention, the first and second vertical support rods 12 and 14 and the upper and lower horizontal basket support rods 22 and 24 may have a circular cross-section having a diameter. For example, the diameter of the first and second vertical support rods 12 and 14 and the upper and lower horizontal basket support rods 22 and 24 may range from 0.05 to 0.6 inch, or from 0.1 to 0.5 inch or from 0.15 to 0.4 inch. However, any other suitable shape and size of first and second vertical support rods 12 and 14 and upper and lower horizontal basket support rods 22 and 24 may be used, e.g., square, rectangular, ovular, hexagonal or the like. Although the first and second vertical support rods 12 and 14 and the upper and lower horizontal basket support rods 22 and 24 shown in FIGS. 1-5 have similar diameters, it is to be understood that any other suitable sizes may be used, e.g., the first and second vertical support rods 12 and 14 may have different diameters compared with upper and lower horizontal basket support rods 22 and 24, the upper and lower horizontal basket support rods 22 and 24 may have different diameters, etc.

As shown in FIGS. 9 and 10, when the draw fastener 32 is tightened to draw the front plate 40 toward the back plate 60, the horizontal basket support rods 22 and 24 are brought into contact with vertical support rods 12 and 14 forming contact points C. In the embodiment shown, the contact points C may be formed at four separate points of the adjustment mechanism 30, however, any other suitable number contact points C may be formed, e.g., zero, one, two, three or more. The contact points C between the horizontal basket support rods 22 and 24 and the vertical support rods 12 and 14 provide direct engagements between the rods which help secure the adjustment mechanism 30 against vertical movements from their selected vertical position with respect to the vertical support rods 12 and 14 even when the baskets 20 are heavily loaded. The contact points C also help secure each basket 20 against horizontal movement. For example, tightening of the draw fastener 32 causes the vertical guide channels 50 and 51 of the front plate 40 to press against the vertical support rods 12 and 14 and forces them toward the back plate 60. This arrangement also forces the vertical support rods 12 and 14 to press into the vertical guide channels 70 and 71 of the back plate 60. Once the vertical support rods 12 and 14 are pressed into the vertical guide channels 70 and 71 of the back plate 60, additional tightening of the draw fastener 32 may form or increase the pressure at the contact points C between the horizontal basket support rods 22 and 24 and the vertical support rods 12 and 14. In the embodiment shown, the contact points C result in each vertical support rod directly contacting each horizontal basket support rod. This allows the horizontal basket support rods 22 and 24 and vertical support rods 12 and 14 to be engaged at four contact points C.

In accordance with an embodiment of the present invention, the draw fastener 32 exerts a central draw force on the planar central region 42 of the front plate 40 and the planar central region 62 of the back plate 60. The draw force on the front surface of the planar central region 42 of the front plate 40 presses the planar central region 42 toward the planar central region 62 of the back plate. The draw force may also deflect the planar central region 62 and the planar central region 42 toward each other due to the slightly flexible nature of the front and back plates 40 and 60. As shown in FIGS. 8-10, the draw force is applied by the draw fastener 32 in a central region between the four contact points C, which are equally spaced from the centrally applied draw force. This equal spacing results in a substantially equal amount of force being applied to each contact point C. In accordance with an embodiment of the present invention, the resilient nature of the front plate 40 and back plate 60 may help to provide the substantially equal amount of force to each contact point C. Although, the draw fastener 32 of the adjustment mechanism 30 shown in FIGS. 8-10 provides a draw force in a central region between the four contact points C, it is to be understood that the draw force may be provided at any other suitable location, e.g., at a location that is not equally spaced from the contact points C.

Figure 12:
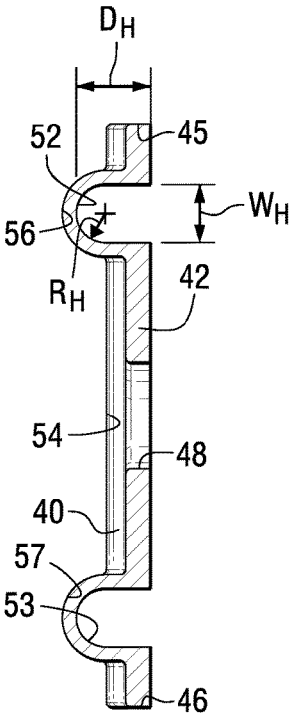
FIG. 12 is a side sectional view of the front plate taken through line 12-12 of FIG. 11.

As shown in FIG. 12, the horizontal guide channels 52 and 53 have a depth $D_H$ and a width $W_H$ selected to allow the horizontal basket support rods 22 and 24 to be totally contained in the horizontal guide channels 52 and 53. For example, the depth $D_H$ of the horizontal guide channels 52 and 53 measured in a direction perpendicular to a planar surface of the front plate 40 may range from 0.1 to 0.8 inch, or from 0.15 to 0.6 inch or from 0.2 to 0.5 inch. In certain embodiments, the depth $D_H$ of the horizontal guide channels 52 and 53 is greater than the diameter of the horizontal basket support rods 22 and 24. For example, the depth $D_H$ of the first and second horizontal guide channels may be from 5 to 100 percent greater, for example, from 10 to 80 percent greater, or from 15 to 50 percent greater than the diameter of the horizontal basket support rods 22 and 24. In certain embodiments, the width $W_H$ of the horizontal guide channels 52 and 53 may typically range from 0.05 to 0.7 inch, for example, from 0.1 to 0.6 inch, or from 0.15 to 0.5 inch. The width $W_H$ may be equal to or slightly greater than the diameter of the horizontal basket support rods 22 and 24.

As shown in FIG. 12, the horizontal guide channels 52 and 53 have a radius $R_H$ that is selected to allow the horizontal basket support rods 22 and 24 to be totally inserted and contained in the horizontal guide channels 52 and 53. For example, the radius $R_H$ of the horizontal guide channels 52 and 53 may range from 0.025 to 0.4 inch, or from 0.05 to 0.3 inch or from 0.1 to 0.25 inch. In accordance with an embodiment of the present invention, the depth $D_H$, width $W_H$ and radius $R_H$ of the horizontal guide channels 52 and 53 may be varied depending on the diameter, size and shape of the horizontal basket support rods 22 and 24. As shown in FIG. 12, the upper and lower horizontal guide channels 52 and 53 may have identical depths $D_H$, widths $W_H$ and/or radiuses $R_H$, or they may be different.

As shown in FIG. 13, the vertical guide channels 50 and 51 of the front plate 40 have a depth $D_V$ and a width $W_V$ selected to allow the vertical support rods 12 and 14 to be partially contained in the vertical guide channels 50 and 51. For example, the depth $D_V$ of the vertical guide channels 50 and 51 measured in a direction perpendicular to a planar surface of the front plate 40 may range from 0.01 to 0.5 inch, or from 0.03 to 0.3 inch or from 0.05 to 0.2 inch. In certain embodiments, the width $W_V$ of the vertical guide channels 50 and 51 may typically range from 0.05 to 0.6 inch, or from 0.1 to 0.5 inch or from 0.15 to 0.4 inch.

As shown in FIG. 13, ends of the vertical guide channels 50 and 51 of the front plate 40 have a radius $R_V$ that is also selected to accommodate and receive the vertical support rods 12 and 14. For example, the radius $R_V$ of the vertical guide channels 50 and 51 may range from 0.025 to 0.4 inch, or from 0.05 to 0.3 inch or from 0.1 to 0.25 inch. In accordance with an embodiment of the present invention, the depth $D_V$, width $W_V$ and radius $R_V$ of the vertical guide channels 50 and 51 may be varied depending on the diameter, size and shape of the vertical support rods 12 and 14. As shown in FIG. 13, the first and second vertical guide channels 50 and 51 of the front plate 40 may have identical depths $D_V$, widths $W_V$ and/or radiuses $R_V$, or they may be different.

As shown in FIG. 16, the vertical guide channels 70 and 71 of the back plate 60 have a depth $D'_V$ and a width $W'_V$ selected to allow the vertical support rods 12 and 14 to be partially contained in the vertical guide channels 70 and 71. For example, the depth $D'_V$ of the vertical guide channels 70 and 71 measured in a direction perpendicular to a planar surface of the back plate 60 may range from 0.01 to 0.5 inch, or from 0.03 to 0.3 inch or from 0.05 to 0.2. In certain embodiments, the width $W'_V$ of the vertical guide channels 70 and 71 may range from 0.05 to 0.6 inch, or from 0.1 to 0.5 inch or from 0.15 to 0.4 inch.

As shown in FIG. 16, the ends of vertical guide channels 70 and 71 have a radius $R'_V$ that is also selected to accommodate and receive the vertical support rods 12 and 14. For example, the radius $R'_V$ of the vertical guide channels 70 and 71 may range from 0.025 to 0.4 inch, or from 0.05 to 0.3 inch or from 0.1 to 0.25 inch. In accordance with an embodiment of the present invention, the depth $D'_V$, width $W'_V$ and radius $R'_V$ of the vertical guide channels 70 and 71 may be varied depending on the size of the vertical support rods 12 and 14. As shown in FIG. 16, the first and second vertical guide channels 70 and 71 of the back plate 60 may have identical depths $D'_V$, widths $W'_V$ and/or radiuses $R'_V$, or they may be different.

In accordance with an embodiment of the present invention, the first and second vertical guide channels 50 and 51 of the front plate 40 and the first and second vertical guide channels 70 and 71 of the back plate 60 form first and second opposing vertical guide channels when the adjustment mechanism 30 is assembled, as shown most clearly in FIGS. 6, 9 and 10. The first and second vertical guide channels 50 and 51 of the front plate 40 and the first and second vertical guide channels 70 and 71 of the back plate 60 may have corresponding depths and/or widths. For example, the depth $D_V$ of the vertical guide channels 50 and 51 of the front plate 40 may be equal to the depth $D'_V$ of the vertical guide channels 70 and 71 of the back plate 60.

In accordance with an embodiment of the present invention, the depths $D_H$ of horizontal guide channels 52 and 53, and the depths $D_V$ of the first and second vertical guide channels 50 and 51, of the front plate 40 are selected to provide the contact points C, as shown in FIGS. 9 and 10. When the adjustment mechanism 30 is tightened, the depth $D_H$ of the horizontal guide channels 52 and 53 and the depths $D_V$ and $D'_V$ of the opposing vertical guide channels 50, 70 and 51, 71, are selected to allow the vertical support rods 12 and 14 and horizontal basket support rods 22 and 24 to contact each other. As shown in FIGS. 9 and 10, when the draw fastener 32 is tightened on the threaded stud 68 to cause the contact points C between the vertical support rods 12 and 14 and the horizontal basket support rods 22 and 24, there may be a gap between the front plate 40 and the back plate 60. Alternatively, the contact points C may still be formed if the front plate 40 and the back plate 60 are brought into contact by the tightening of the adjustment mechanism 30.

In the embodiment shown, the front plate 40 includes two vertical guide channels 50 and 51 and two horizontal guide channels 52 and 53. However, it is it be understood that the front plate 40 may only include horizontal guide channels 52 and 53, in which case, only the back plate 60 may include vertical guide channels 50 and 51. In this alternative embodiment, the depth $D'_V$ of the vertical guide channels 70 and 71 may be altered to accommodate a greater portion of the diameter of the vertical support rods 12 and 14. For example, the depth $D'_V$ and width $W'_V$ of the vertical guide channels 70 and 71 may be similar to the depth $D_H$ and/or width $W_H$ of the horizontal guide channels 52 and 53, as previously described herein. In accordance with another embodiment, the front plate 40 may only include vertical guide channels, and the back plate 60 may only include both horizontal and vertical guide channels.

Figure 18:
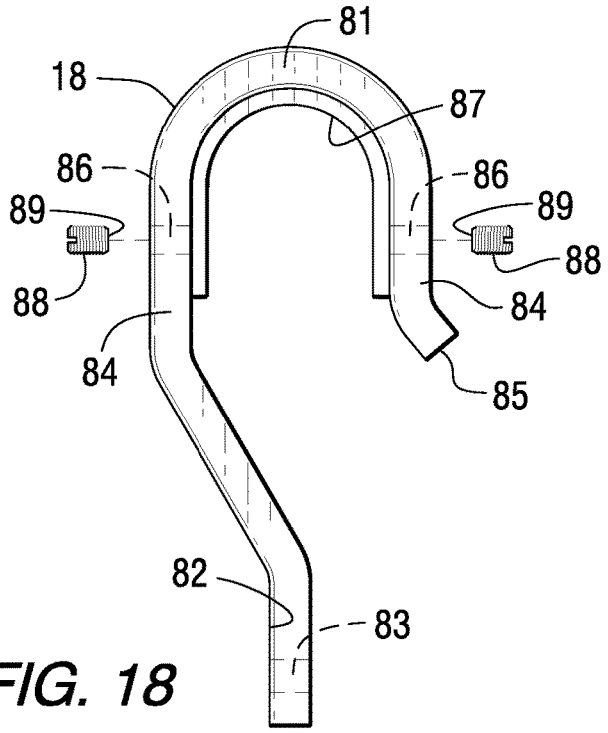
FIG. 18 is a front view of a tilt-resisting support hook in accordance with an embodiment of the present invention.

As shown in detail in FIG. 18, the tilt-resisting support hook 18 comprises an upper pipe engaging portion 81 and a lower portion 82 connected to the vertical support structure 10. In the embodiment shown, the upper pipe engaging portion 81 is generally "U"-shaped and comprises two downwardly extending side legs 84. However, any other suitable shape of upper pipe engaging portion may be used. In the embodiment shown in FIG. 18, one downwardly extending side leg 84 forms an open end 85, while the other downwardly extending side leg 84 is connected to the vertical support structure 10. The open end 85 of the upper pipe engaging portion 81 allows the tilt-resisting support hook 18 to be easily installed on shower pipes having various sizes of shower heads. While the tilt-resisting support hook 18 shown in FIG. 18 has an open end 85, in other embodiments the downwardly extending side legs 84 may form a closed loop at the lower portion 82 and/or to the vertical support structure 10. For example, the downwardly extending side legs 84 of the generally U-shaped upper pipe engaging portion 81 may extend downwardly to couple with the vertical support rods 12 and 14 (not shown). In this embodiment, the downwardly extending side legs 84 may be connected to the vertical support rods 12 and 14 by any suitable attachment means, such as, mechanical fasteners or welding, or may be integrally formed therewith.

Figure 3:
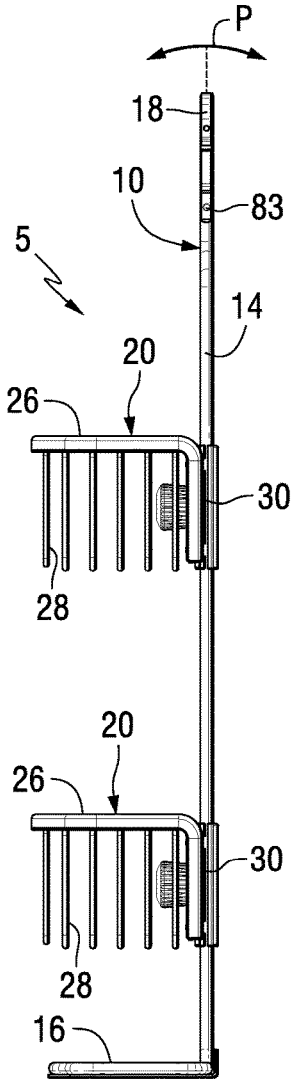
FIG. 3 is a side view of the shower caddy of FIG. 1.

The lower portion 82 may include a support structure connection hole 83. In accordance with an embodiment of the present invention, the vertical support structure 10 may be pivotably attached to the tilt-resisting support hook 18 by inserting a mechanical fastener through the support structure connection hole 83. This arrangement allows the shower caddy assembly 5 to hang vertically when mounted on shower pipes that may be oriented at different angles or when mounted at a location along the pipe that is offset from the back wall of a shower or bath enclosure against which the caddy rests. As shown in FIG. 3, the support hook 18 may be pivotable P around an axis of rotation corresponding to a longitudinal axis of the mechanical fastener in the support structure connection hole 83. Alternatively, the tilt-resisting support hook 18 and the vertical support structure 10 may be fixed in relation to each other or integrally formed. The tilt-resisting support hook 18 may be made of any suitable materials, including corrosion resistant metals such as aluminum and/or stainless steel, plastic or the like.

In accordance with an embodiment of the present invention, the generally U-shaped upper pipe engaging portion 81 may include a resilient liner 87 positioned along at least a portion of an interior surface of the upper pipe engaging portion. In accordance with an embodiment of the present invention, the resilient liner 87 may be made of natural rubber, synthetic rubber, soft polymer, or the like. The resilient liner 87 may be affixed to the interior surface of the generally U-shaped upper pipe engaging portion 81 by any suitable means such as an adhesive.

In accordance with an embodiment of the present invention, the generally U-shaped upper pipe engaging portion 81 comprises at least one threaded fastener hole 86 receiving a threaded fastener 88. As shown in FIG. 18, each downwardly extending side leg 84 may include a threaded fastener hole 86. In the embodiment shown, there are two threaded fastener holes 86 and associated fasteners 88, but any other suitable number of threaded fastener holes may be used. For example, there may be zero, one, three, four or more threaded fasteners. Each threaded fastener 88 extends from the exterior side surface to an interior side surface of the downwardly extending side leg 84 to press against the shower pipe. In the embodiment shown, a threaded fastener 88 is inserted into each threaded fastener hole 86 and tightened in order to secure the tilt-resisting support hook 18 and shower caddy assembly 5 in place.

The threaded fasteners 88 may be threaded and may comprise an Allen screw, thumb screw, flat head screw, Phillips head screw, or the like. The end 89 of each threaded fastener 88 may contact the resilient liner 87 to press against the shower pipe when tightened without direct contact between the threaded fasteners 88 and the shower pipe. The resilient liner 87 is forced against the shower pipe by the threaded fastener 88 to reduce or eliminate unwanted movement of the tilt-resisting support hook 18 and the shower caddy assembly 5. In the embodiment shown, the tilt-resisting support hook 18 comprising the resilient liner 87 and the threaded fastener holes 86 and associated fasteners 88 provide a tilt-resisting locking mechanism. In accordance with another embodiment of the present invention, the tilt-resisting support hook 18 may not include a resilient liner 87 and may instead include threaded fasteners 88 having resilient material positioned at their ends. For example, the threaded fasteners 88 may be an Allen type screw having a rubber tip on their ends that can be tightened directly against the shower pipe.

While a tilt-resisting support hook 18 is described herein, any other suitable tilt-resisting or non-tilt resisting support structure capable of supporting the caddy assembly 5 on a shower pipe may be used. Alternative tilt-resisting supports may include various types of clamps, clips and fasteners, such as disclosed in U.S. Patent Application Publication No. US2014/0224754 A1 published Aug. 14, 2014, which is incorporated herein by reference.

Figure 19:
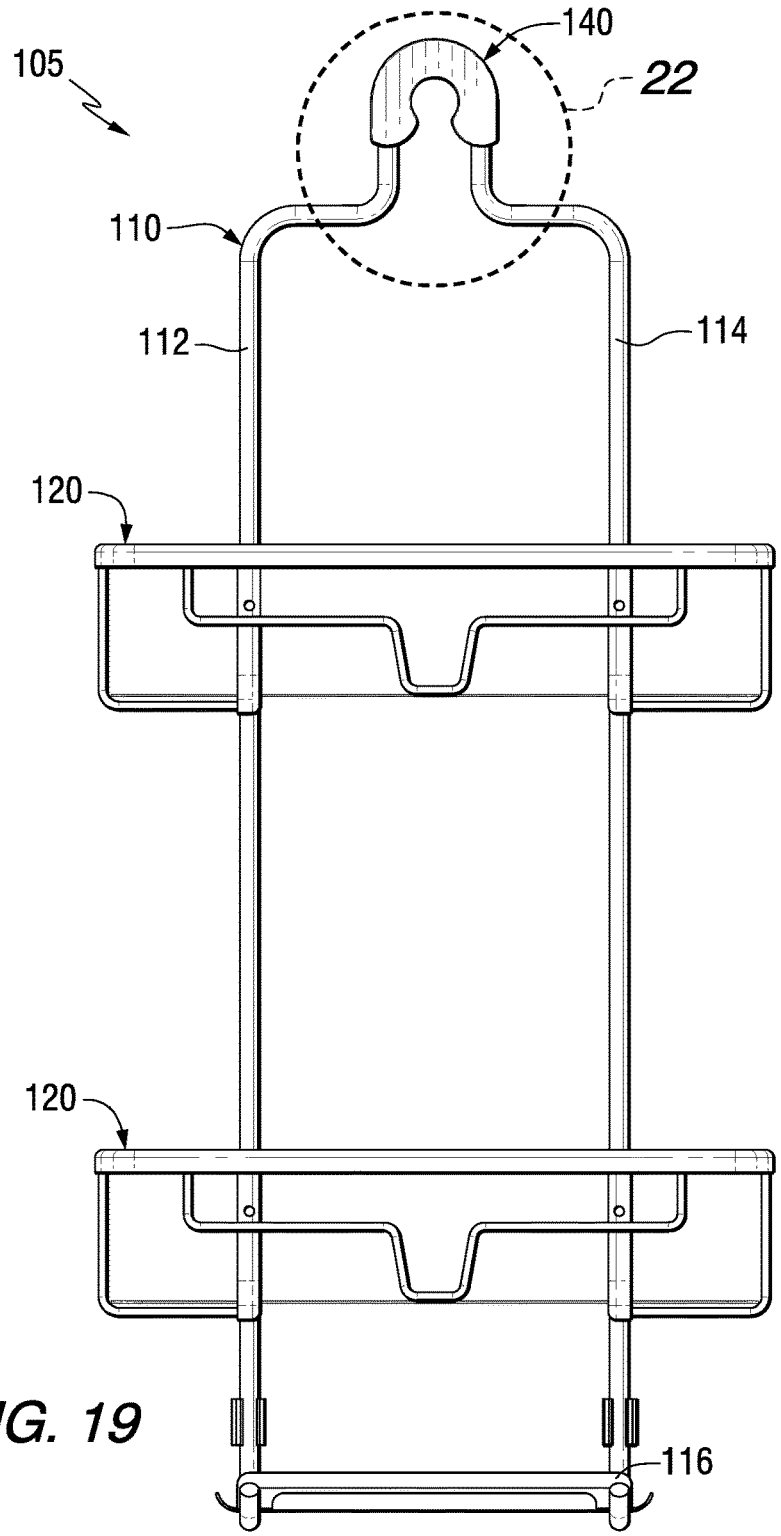
FIG. 19 is a front view of a shower caddy assembly including a tilt-resisting support mechanism in accordance with an embodiment of the present invention.
Figure 20:
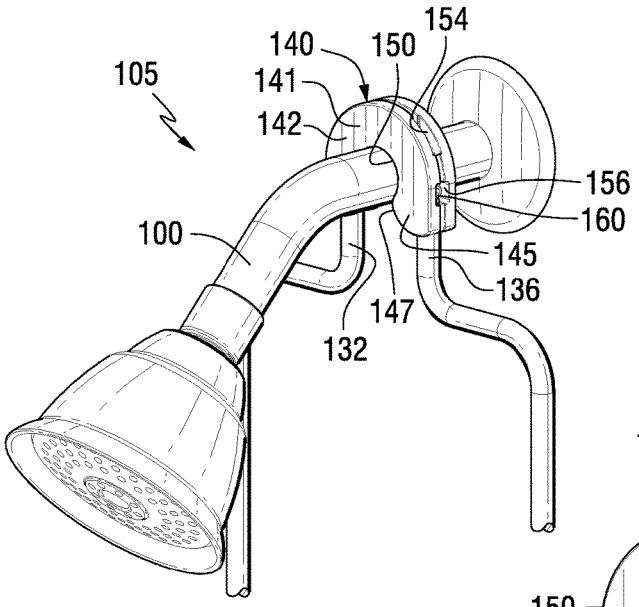
FIG. 20 is an isometric view of a portion of the shower caddy assembly of FIG. 19.

FIGS. 19-24 illustrate a shower caddy assembly 105 in accordance with a further embodiment of the present invention. As shown in FIG. 19, a shower caddy assembly includes a vertical support structure 110 comprising a first vertical support rod 112, a second vertical support rod 114 parallel with the first vertical support rod 112, and a bottom shelf 116. As shown in FIG. 20, the vertical support structure 110 may be mounted on a shower pipe 100 connected to a shower head by a tilt-resisting support mechanism 140, which is described in more detail below. In the embodiment shown, the shower caddy assembly 105 includes two baskets 120 mounted on the vertical support structure 110 by any suitable means. The baskets 120 may be of the same or similar construction as the baskets 20 described in the previous embodiment. While two baskets 120 of similar size are shown in this embodiment, any other suitable number of baskets 120 may be used. For example, one, three, four or more baskets may be mounted on the vertical support structure 110. In addition, the baskets may vary in size, for example, the top basket may be smaller than the bottom basket.

Figure 21:
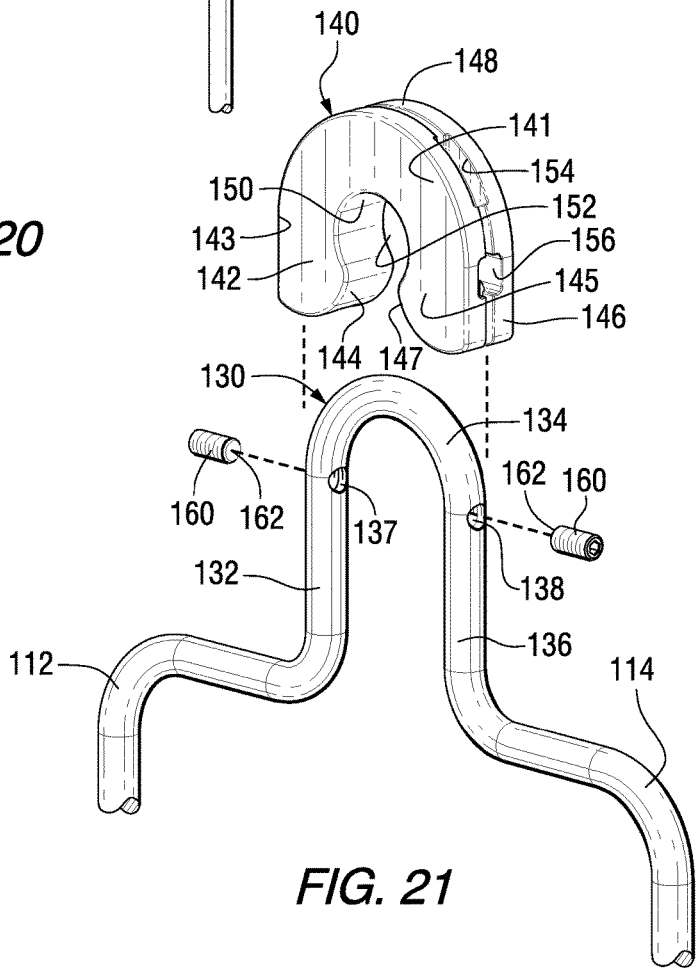
FIG. 21 is an exploded isometric view of the adjustment mechanism of FIG. 19.

As shown in detail in FIGS. 20 and 21, the tilt-resisting support mechanism 140 comprises a tilt-resisting support hook 130 and a snap clip 141. In the embodiment shown, the support hook 130 is generally "U"-shaped comprising an upper curved portion 134 and first and second downwardly extending side legs 132 and 136. However, any other suitable shape of support hook may be used, such as, an open hook or the like. In the embodiment shown in FIGS. 20 and 21, first and second downwardly extending side legs 132 and 136 are respectively coupled with the first vertical support rod 112 and the second vertical support rod 114 of the vertical support structure 110. In the embodiment shown, the support hook 130 and the vertical support structure 110 form a closed loop, however, any other suitable arrangement may be used, e.g., the support hook may be formed as an open hook. In accordance with an embodiment of the present invention, the first and second downwardly extending side legs 132 and 136 may be integrally formed with the vertical support rods 112 and 114, or may be connected by any suitable attachment means, such as, mechanical fasteners or welding.

In accordance with an embodiment of the present invention, the snap clip 141 of the tilt-resisting support mechanism 140 is configured to be received by the support hook 130. In accordance with an embodiment of the present invention, the snap clip 141 may be made of natural rubber, synthetic rubber, silicone, polyvinyl chloride, soft polymer, or the like. As shown in FIGS. 19-24, the snap clip 141 may be a comprise a one-piece body. While a one-piece snap clip body is described herein, any other suitable construction may be used, e.g., the snap clip may be constructed from two or more separate, attached components. The snap clip 141 is generally "U"-shaped comprising an upper curved portion 148 and first and second downwardly extending side legs 142 and 145. The first downwardly extending side leg 142 includes an exterior surface 143 and an interior surface 144 and the second downwardly extending side leg 145 includes an exterior surface 146 and an interior surface 147.

As shown in FIGS. 19-22 and 24, the interior surfaces 144 and 147 of the first and second downwardly extending side legs 142 and 145 extend toward each other to form bulbous shower pipe gripping ends. The gap between the interior surface 144 of the first downwardly extending side leg 142 and the interior surface 147 of the second downwardly extending side leg 145 allows the snap clip 141 to be received on the shower pipe 100. As shown in FIGS. 19-22, the gripping ends form a generally horse-shoe shaped snap clip 141. However, any other suitable shape of snap clip may be used, e.g., rectangular, circular, ovular, triangular or the like. The gap between the interior surfaces 144 and 147 of the first and second downwardly extending side legs 142 and 145 is narrower that the diameter of the shower pipe 100. This results in the bulbous gripping ends of the snap clip 141 being deformed radially outward by the shower pipe 100 during installation. This arrangement allows for frictional resistance to prevent movement between the snap-clip 141 and the shower pipe 100.

Figure 22:
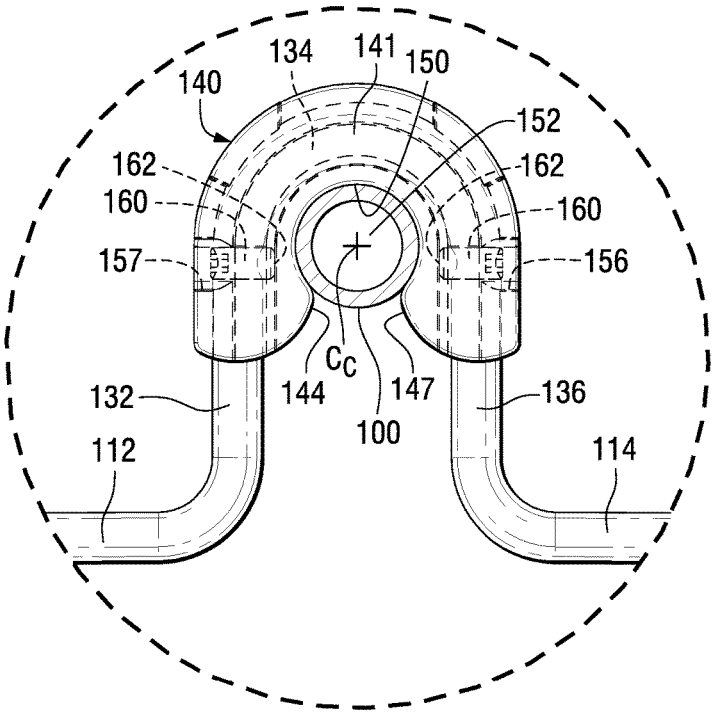
FIG. 22 is a magnified front view of the tilt-resisting support hook of FIG. 19.
Figure 23:
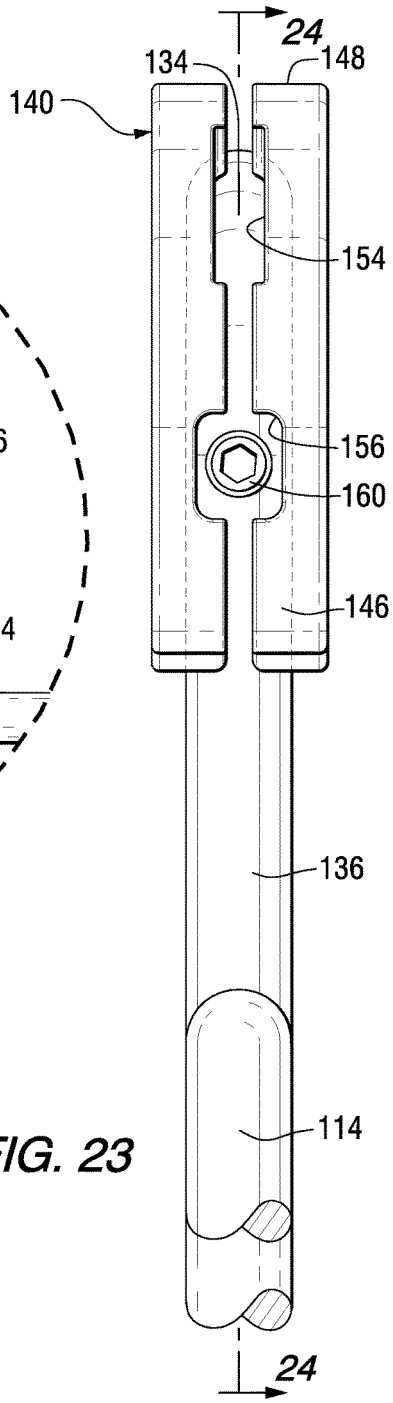
FIG. 23 is a side view of a portion of the shower caddy assembly of FIG. 19.

As shown in FIGS. 20, 21 and 23, the exterior surface of the upper curved portion 148 and first and second downwardly extending side legs 142 and 145 of the snap clip 141 comprises a support hook channel 154 for receiving the support hook 130 of the vertical support structure 110. In the embodiment shown, the support hook channel 154 extends from the bottom of the first downwardly extending side leg 142 around the exterior surfaces 143 and 146 of the first and second downwardly extending side legs to the bottom of the second downwardly extending side leg 145. In accordance with an embodiment of the present invention, the walls of the support hook channel 154 may be separable to receive the support hook 130. In accordance with an embodiment of the invention, to engage the snap clip 141 with the support hook 130, the walls of the support hook channel 154 are separated and pulled over the support hook. As shown in FIGS. 22 and 23, once the snap clip 141 completely engages the support hook 130 inside the support hook channel 154, the walls of the support hook channel 154 return to their original position. Alternatively, the snap clip 141 may be secured to the support hook by any other suitable means or may be integrally formed with the support hook 130.

In accordance with an embodiment of the present invention, the upper portion 148 of the snap clip 141 includes a curved interior wall having an interior pipe gripping surface 150. The interior pipe gripping surface 150 of the curved wall is located between the interior surfaces 144 and 147 of the first and second downwardly extending side legs 142 and 145. In the embodiment shown, the interior pipe gripping surface 150 is semi-circular and forms a generally cylindrical pipe receiving channel 152. As shown in FIG. 22, the pipe receiving channel 152 may be sized to receive the shower pipe 100.

Figure 24:
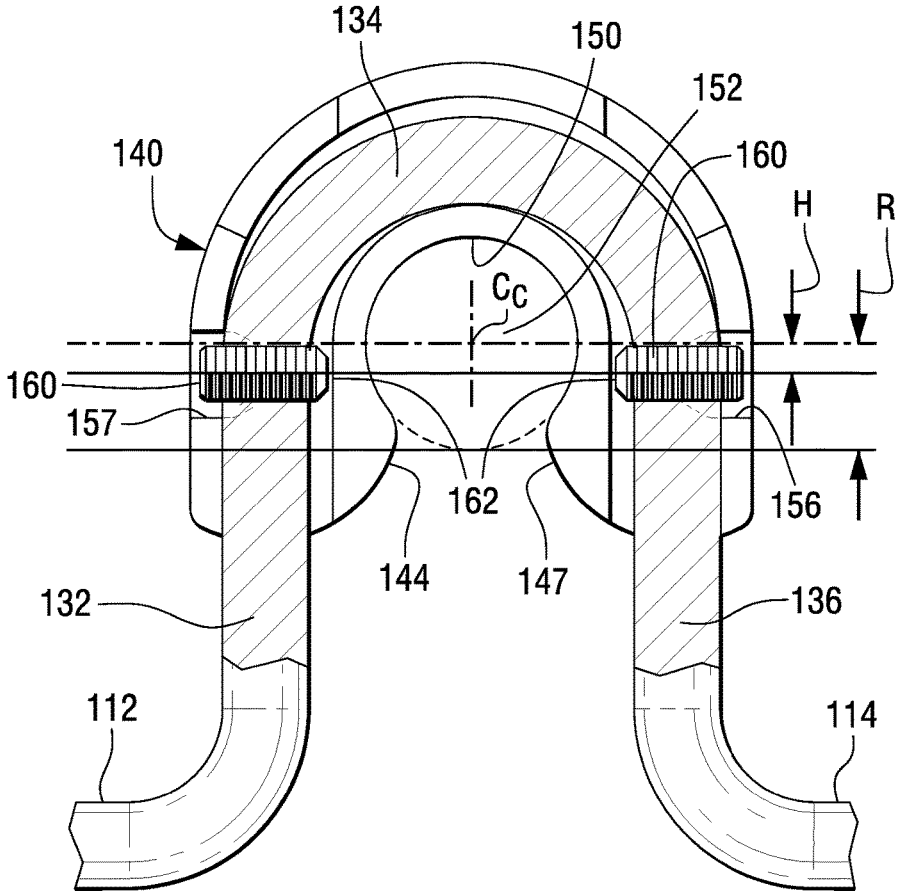
FIG. 24 is a front sectional view of the tilt-resisting support mechanism taken through line 24-24 of FIG. 23

As shown in FIG. 24, the pipe receiving channel 152 has a radius R and a centerline height $C_C$ selected to allow the snap clip 141 to receive the shower pipe 100. For example, the pipe receiving channel may have a radius R configured to engage with a conventional ½" NPT shower pipe 100. However, the pipe receiving channel 152 may be configured to receive any other size of shower pipe. The pipe receiving channel 152 thus allows the interior pipe gripping surface 150 of the snap clip 141 to frictionally engage the shower pipe. The interior pipe gripping surface 150 may be made of the same material as the rest of the snap clip and/or may include additional features for greater frictional resistance to rotation. For example, the interior pipe gripping surface 150 may be a ribbed surface and/or include a resilient material with a high coefficient of friction.

In accordance with an embodiment of the present invention, each downwardly extending side leg 132 and 136 of support structure loop 130 comprise at least one threaded fastener hole 137 and 138 receiving a threaded fastener 160. As shown in FIGS. 21, 22 and 24, each downwardly extending side leg 132 and 136 may include a threaded fastener hole 137 and 138. In the embodiment shown, there are two threaded fastener holes 137 and 138 and associated fasteners 160, but any other suitable number of threaded fastener holes may be used. For example, there may be zero, one, three, four or more threaded fasteners. Each threaded fastener 160 extends from the exterior side surface to an interior side surface of the downwardly extending side leg 132 and 136 to press against the snap clip 141. In an alternative embodiment, holes may be provided through the interior pipe gripping surface 150 of the snap clip such that the threaded fasteners 160 can directly contact the shower pipe 100. In the embodiment shown in FIGS. 21, 22 and 24, a threaded fastener 160 is inserted into each threaded fastener hole 137 and 138 and tightened in order to secure the tilt-resisting support mechanism 140 and shower caddy assembly 105 in place on the shower pipe 100.

As shown in FIG. 24, the threaded fasteners 160 are located at a height H measured downward from the centerline height $C_C$ of the pipe receiving channel 152. The threaded fasteners 160 thus press against the snap clip 141 at a location below the centerline of the pipe receiving channel 152. For example, the threaded fasteners are located at a height H measured downward from the centerline height $C_C$ of the pipe receiving channel 152 of from 0 to 60 percent of the radius R of the pipe receiving channel 152, or from 5 to 50 percent, or from 10 to 40 percent. In accordance with an embodiment of the present invention, this arrangement provides that the bottom of the shower pipe 100 may be contacted by the bulbous gripping ends of the first and second legs 142 and 145 of the snap clip 141. In addition, locating the threaded fasteners below the centerline height $C_C$ of the pipe receiving channel 152 results in the inward movement of the at least one threaded fastener drawing the generally cylindrical pipe receiving channel 152 downward against the shower pipe 102. The arrangement allows for greater frictional engagement between the shower pipe 100 and the snap clip 142 to reduce or eliminate unwanted movement of the tilt-resisting support mechanism 140 and the shower caddy assembly 105.

The threaded fasteners 160 may be threaded and may comprise an Allen screw, thumb screw, flat head screw, Phillips head screw, or the like. As shown in FIGS. 20-24, the exterior surfaces 143 and 146 of the first and second legs 142 and 145 of the snap clip 141 may have fastener adjustment recesses 156 and 157 to allow the threaded fasteners 160 to be tightened. The end 162 of each threaded fastener 160 may contact the snap clip 141 to press against the shower pipe 100 when tightened without direct contact between the threaded fasteners 160 and the shower pipe. The snap clip 141 is forced against the shower pipe by the threaded fastener 160 to further reduce or eliminate unwanted movement of the tilt-resisting support mechanism 140 and the shower caddy assembly 105. In the embodiment shown, the tilt-resisting support mechanism comprising the support structure loop 130, the snap clip 141 and the threaded fastener holes 137 and 138, and associated fasteners 160 provide a tilt-resisting locking mechanism. In accordance with another embodiment of the present invention, the bulbous gripping ends of the first and second legs 142 and

145 of the snap clip 141 may include thru-holes to allow the threaded fasteners 160 to contact the shower pipe 100 directly. For example, the threaded fasteners 160 may include a resilient material on their ends that can be tightened directly against the shower pipe 100.

Whereas particular embodiments of this invention have been described above for purposes of illustration, it will be evident to those skilled in the art that numerous variations of the details of the present invention may be made without departing from the invention as defined in the appended claims.

What is claimed is:

1. A tilt-resisting shower caddy assembly comprising:

a tilt-resisting support hook comprising a generally U-shaped upper portion and first and second downwardly extending side legs;

a vertical support structure connected to at least one of the downwardly extending side legs supporting at least one basket;

a snap clip engaging the generally U-shaped upper portion comprising an upper curved portion and first and second legs having bulbous gripping ends, the snap clip having an interior surface defining a generally cylindrical shower pipe receiving channel having a radius (R) and defining a centerline height (Cc); and at least one threaded fastener extending into one of the legs of the snap clip and through one of the first and second downwardly extending side legs of the tilt-resisting support hook at a height (H) measured downward from the centerline height (Cc) of from 0 to 60 percent of the radius (R) of the generally cylindrical shower pipe receiving channel structured to thereby resist tilting of the shower caddy assembly when installed on the shower pipe.

2. The tilt-resisting shower caddy assembly of claim 1, wherein the height (H) is from 5 to 50 percent of the radius (R).

3. The tilt-resisting shower caddy assembly of claim 1, wherein the height (H) is from 10 to 40 percent of the radius (R).

4. The tilt-resisting shower caddy assembly of claim 1, wherein the bulbous gripping ends of the first and second legs of the snap clip are deformable radially outward when the snap clip is installed on the shower pipe.

5. The tilt-resisting shower caddy assembly of claim 1, wherein, when in use, inward movement of the at least one threaded fastener draws the generally cylindrical shower pipe receiving channel downward against the shower pipe.

6. The tilt-resisting shower caddy assembly of claim 1, wherein the at least one threaded fastener contacts the interior surface of the snap clip and moves the interior surface inward against the shower pipe when the threaded fastener is extended inward.

7. The tilt-resisting shower caddy assembly of claim 1, wherein the interior surface of the snap clip comprises a resilient pipe gripping material.

8. The tilt-resisting shower caddy assembly of claim 7, wherein the resilient pipe gripping material of the interior surface of the snap clip comprises a polymer or rubber.

9. The tilt-resisting shower caddy assembly of claim 1, wherein exterior side surfaces of the first and second legs of the snap clip comprise fastener adjustment recesses.

10. The tilt-resisting shower caddy assembly of claim 1, wherein the at least one threaded fastener comprises a first threaded fastener and a second threaded fastener; wherein the first threaded fastener extends into the first leg of the snap clip and through the first downwardly extending side leg of the tilt-resisting support hook; wherein the second threaded fastener extends into the second leg of the snap clip and through the second downwardly extending side leg of the tilt-resisting support hook.

11. The tilt-resisting shower caddy assembly of claim 1, wherein the snap clip comprises a support hook channel for engaging the tilt-resisting support hook.

12. The tilt-resisting shower caddy assembly of claim 1, wherein the tilt-resisting support hook is integrally formed with the vertical support structure.

13. The tilt-resisting shower caddy assembly of claim 1, wherein the at least one basket is horizontally adjustable.

14. The tilt-resisting shower caddy assembly of claim 13, wherein the at least one basket is vertically adjustable.

* * * * *